US006360411B1

(12) United States Patent
Bortz

(10) Patent No.: US 6,360,411 B1
(45) Date of Patent: Mar. 26, 2002

(54) TAMPER EVIDENT BUCKLE

(75) Inventor: Gary Bortz, N Ryde (AU)

(73) Assignee: Harcor Security Seals Pty Limited, New South Wales (AU)

( * ) Notice: Subject to any disclaimer, the term of this patent is extended or adjusted under 35 U.S.C. 154(b) by 0 days.

(21) Appl. No.: 09/521,817

(22) Filed: Mar. 9, 2000

(30) Foreign Application Priority Data

Mar. 9, 1999 (AU) ..... PP9082

(51) Int. Cl.[7] ..... A44B 21/00
(52) U.S. Cl. ..... 24/704.2; 24/625
(58) Field of Search ..... 24/704.1, 704.2, 24/614, 615, 616, 625; 292/307 R, 307 B, 325, 328, 330, 282, 285, 286

(56) References Cited

U.S. PATENT DOCUMENTS

| | | | | |
|---|---|---|---|---|
| 1,815,016 | A | * | 7/1931 | Street |
| 4,106,801 | A | * | 8/1978 | Castro Neto |
| 4,197,982 | A | * | 4/1980 | Casteo Netto |
| RE31,706 | E | * | 10/1984 | Castro Neto |
| 4,512,599 | A | * | 4/1985 | Castro Netto |
| 4,912,950 | A | * | 4/1990 | Crowle |
| 5,568,951 | A | | 10/1996 | Morgan |
| 5,655,802 | A | | 8/1997 | Topp et al. |
| 5,915,629 | A | | 6/1999 | Ribeiro |
| 6,226,839 | B1 | * | 5/2001 | Sayegh |

FOREIGN PATENT DOCUMENTS

| | | | |
|---|---|---|---|
| EP | 874346 A2 | * | 10/1998 |
| IT | 1284958 | | 5/1998 |
| JP | 10-167317 | * | 6/1998 |

* cited by examiner

*Primary Examiner*—James R. Brittain
(74) *Attorney, Agent, or Firm*—Welsh & Katz, Ltd.

(57) ABSTRACT

A tamper evident buckle including a first part adapted to be attached to one end of an elongate strap, a second part adapted to be attached to the other end of the strap, the first and second parts including respective engagement means for releasably engaging the two parts together, an enclosure movable between a first position wherein the first and second parts are freely engageable and disengageable and a second position wherein the enclosure substantially encloses the engaged together first and second parts, and a seal including a main body, comprised of at least one component, and at least one deflectable member, wherein the seal is adapted to engage the enclosure in the second operative position and to prevent movement from the second operative position to the first operative position unless said seal is broken. The buckle may be used to secure the contents of a container, such as a cash box, against unauthorized tampering.

10 Claims, 5 Drawing Sheets

TAMPER EVIDENT BUCKLE

This invention relates to a tamper evident device, especially for use with valuable items, so as to indicate if tampering has occurred. In particular, the invention relates to a tamper evident buckle.

When transporting or storing valuable items in containers it is important to be able to determine if the container has been tampered with. There are special "cash boxes" available for the storage or transport of cash or other small items. However, there are objects for which special security containers may not be available or for which tamper evident systems are not available.

It is known to provide simple seals for indicating tampering on containers such as an adhesive backed paper label in which an adhesive backed label bearing an authorised signature is secured across the closure. A more elaborate version of this type of tamper evident security device has been described in U.S. Pat. No. 5,568,951. The device includes a base and cover for securing two ends of a strap therein. The tamper evident means comprises a simple adhesive backed labelling strip affixed to the top surface of the cover and base. If the strip is tampered with to release the strap the damaged strip evidences the interference. This type of tamper evident strip is open to the same abuse as the more simple adhesive backed labels directly applied to the container to be sealed. It may be possible to lift the label from the cover by a variety of methods such as heat, steam or appropriate solvents without leaving a clear indication that tampering has occurred.

The present invention relates to tamper evident devices including a buckle with first and second parts adapted to be attached to a strap or belt and adapted to engage in a locking relationship. An enclosure is provided which surrounds the two parts and prevents their removal from each other while enclosed. A seal is provided which seals the enclosure and which must be broken to open the enclosure and release the two parts, whereby the seal cannot be re-used. Preferably the strap cannot be adjusted whilst the enclosure surrounds the two parts.

Accordingly, in one broad form, the invention provides a tamper evident buckle including:

- a first part adapted to be attached to one end of an elongate strap;
- a second part adapted to be attached to the opposed end of the strap;
- said first and second parts including respective engagement means for releasably engaging the two parts together;
- an enclosure movable between a first operative position wherein the first and second parts are freely engageable and disengageable and a second operative position wherein the enclosure substantially encloses the engaged together first and second parts; and
- a seal including a main body, comprised of at least one component, and at least one deflectable member, wherein the seal is adapted to engage the enclosure in the second operative position and to prevent movement from the second operative position to the first operative position unless said seal is broken.

Preferably the enclosure includes a base and a cover. The cover may be hinged to the base or may be a separate component which engages with the base.

The first part may be permanently affixed at one end of the strap and the second part may be mounted on the strap for movement therealong.

When the two parts are engaged together and the enclosure is in the second operative position, preferably adjustment of the second part along the strap is prevented.

The first part and the base may be an integral component and the strap may be permanently affixed to the component.

The first part may include a female member having a passageway into which the second part passes. The second part may engage the internal surface of the passageway and/or one of the ends of the passageway. Preferably the second part includes two spaced apart arms having re-entrant barbs which pass through the passageway and engage the end of the passageway.

The seal may engage only the enclosure means or it may also engage the first and/or the second part. The main body of the seal may include at least two distinct components. The at least two distinct components may be joined by a frangible connection. The frangible connection may be in the form of a weakened bridge or hinge, or a plurality of same. The frangible connection may be formed by one of the components having a narrow construction at least in the regions of the join or joins between the components.

The second part preferably has a transverse body from which the two arms extend having an upper surface which is lower than the upper surface of the arms so that when engaged in the passageway an opening into the passageway is defined above the transverse body and between the two arms.

The cover may include a slot which aligns with the opening, so allowing the seal to be inserted into the opening.

The seal preferably has at least one arm which extends out of the plane of the opening to engage an inner face of the body.

The at least one arm may engage the inner wall or walls of the female member or may engage on one or more external end surfaces of the wall of the passageway.

The invention shall be better understood from the following, non-limiting, description of a preferred embodiment of the invention, in which.

Figure 1:
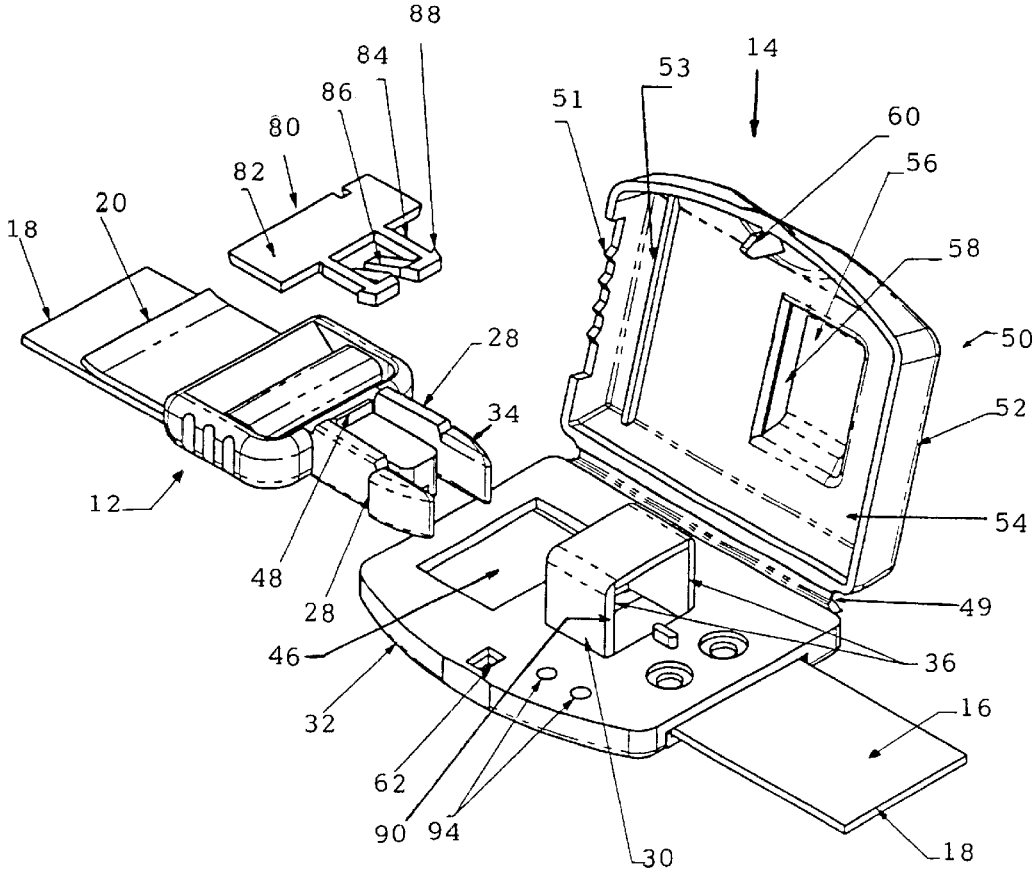
FIG. 1 is a perspective view of the buckle in the disassembled state.

Referring to FIGS. 1 to 10, there is provided a buckle 10, which has a male clip component 12 and a female housing/cover component 14. One end 16 of a strap 18 is permanently attached to the housing 14. The method of attachment will be discussed later. The other end 20 of the strap 18 is looped around a cross bar 22 (see FIGS. 6 and 7) on the male clip 12 and underneath a guard bar 24. The lower edge 26 of the locking bar is below the cross-bar 22 relative to the plane of the male clip 12 and so when the strap is in tension the strap bears against the locking bar 26 and is prevented from coming loose. To release the strap, the clip must be pivoted so the direction of pull in the strap does not cause the strap to bear on the locking bar 26.

The male clip 12 has two arms 28, which engage in a female passageway 30. The passageway 30 is defined by an inverted channel extending upwardly from the base 32 of the housing 14. The arms 28 have angled ends 34 having cammed surfaces which pass through the channel and hook onto the end walls 36 of the passageway 30. The arms 28 must be pressed toward each other to enable release of the clip from the housing 14.

Figure 2:
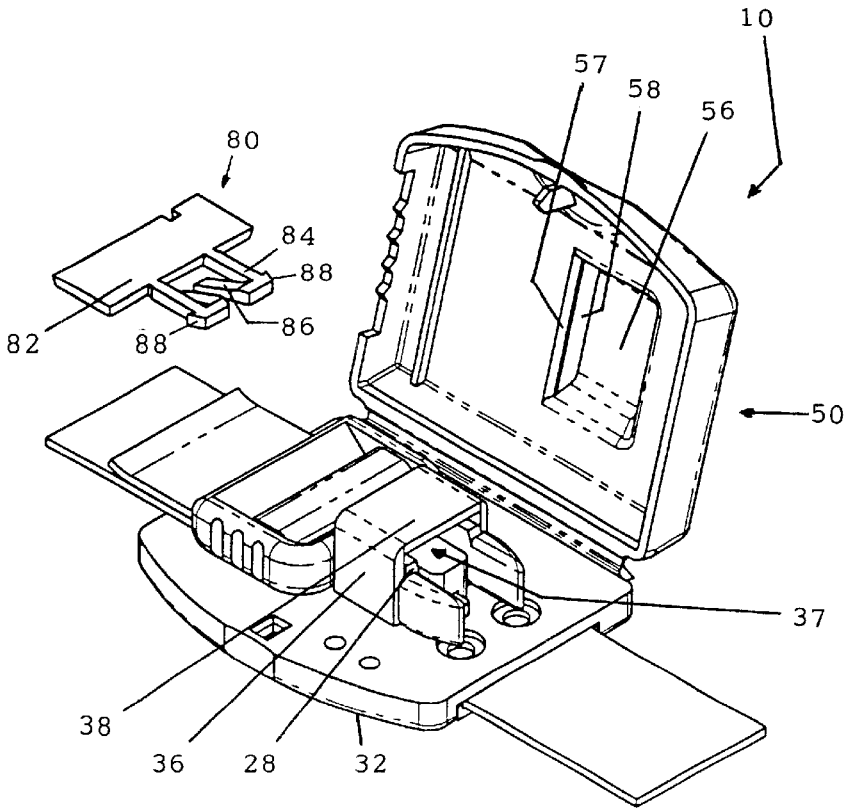
FIG. 2 is a perspective view of the buckle of FIG. 1 in a part assembled state.

The height of the arms 28 is less than the inside height of the passageway 30 and, as can be seen in FIG. 2, a small passageway 37 is left between the top of the arms 28 and the internal surface of the top wall 38 of the passageway 30. Intermediate the two arms 28 is a guide bar 40 (see FIG. 6) which passes through the passageway 30 and engages guide members 42 on the base on either end of the passageway 30. In the preferred form shown there is a first void 44 in the base 32, but this is only for manufacturing convenience. If desired, the base 32 may be continuous beneath the passageway 30 with a single elongate guide member 42 extending through the channel. The guide bar 40 has its base in the same plane as the base of the two arms but is shorter. At the junction of the bar 40 with the main body of the clip (12) there is provided a vertical wall 48. The top surface of the wall is below the top surface of the two arms.

A second void 46 is provided in the base 30. This is to provide clearance for the strap attached to the clip 12, so the clip may sit flat upon the base 32.

Hinged along one side of the base 30 along hinge 49 is a cover 50 having a peripheral wall 52 and top wall 54. In the top wall 54 there is provided a recess 56 for receiving the top portion of the passageway 30. The recess 56 also has an opening 58. The cover is sized so that when rotated about the hinge 49, the peripheral wall 52 lies on the top surface of base 32 with the passageway 30 extending into the recess 56. A guide rib 60 on the wall 52 engages in slot 62 to aid in alignment of the cover 50 with the base 32. The peripheral wall has a serrated opening 51 and a locking rib 53 extends across the top wall 54.

The housing 14 also includes a strap retainer 64 (see FIGS. 4 and 5), hinged about hinge 66 to base 32. The retainer has two holes 68 which when folded against bottom surface of the base 32 align with holes 70 in the base. As seen in FIG. 5 the lower surface of the base 32 has a recessed channel 72 to receive the retainer 64. The opposed surface of the retainer 64 is provided with open ended channel 74 at its free end, sized to receive the end 16 of strap 18. Within this recess 74 are a series of protrusions 76 which extend into the strap to aid retention. When folded over onto the strap 18, rivets are located in holes 68, 70 to permanently affix the strap to the housing 14.

In use the strap 18 is placed around the object to seal and the male clip 12 slid along the strap to the approximate required length. The male clip 12 is then inserted into the female passageway 30, thereby forming a closed loop around the object. The free end 20 of the strap is then pulled to tighten the strap about the object.

The cover 50 is then closed against the base 32, enclosing the male clip 12 within the passageway 30. The serrated opening 51 and locking rib 53 engage the strap 18 and so aid in preventing any movement of the strap relative to the male clip 12. The rear wall 57 (see FIG. 2) of the recess 56 extends to the height of the arms with the slot 58 aligning with the passageway 37 formed between the top of the arms 28 and the top 38 of the passageway 30.

A seal clip 80, such as that disclosed in Australian patent application No. 60610/98, the contents of which are hereby incorporated, is inserted through the slot 58 into the passageway 37. The seal 80 includes a cross bar 82 and two arms 84 extending in the plane of the cross bar 82. Extending downwardly out of the plane of the cross bar from the free end of each of the arms 84 is a leg 86. The free end of each arm 84 is provided with a barb 88.

The female passageway 30 has two longitudinally extending ribs, 59 (see FIG. 5) which extend along the junction of the side walls 36 and top wall 38. These ribs 59 commence at the inner end 61 and extend part way along the junction, stopping short of the outer end wall 90. The arms 84 are sized and spaced apart so that on insertion, the arms 84 extend so the barbs 88 engage the free end of the ribs 59 within the passageway 30.

On insertion into the slot, the arms 84 bend inwards to clear the ribs 59 and the legs 86 bend upwards to lie in the plane of the slot. Once inserted the legs 86 spring back to engage the end of the ribs 59 and downwards to lie below the upper edge of end wall 48 of male clip 12. Thus rearwards movement of the seal is prevented by the engagement of the legs 86 on end wall 48 and by the engagement of side barbs 88 to the free end of the ribs 59. The seal 80 is thus prevented from being removed intact from the slot 58 due to the combined action of legs 86 and barbs 88. Whilst the seal is in place and intact, the cover 52 cannot be raised and hence the male clip 12 cannot be removed from the passageway 30.

Figure 4:
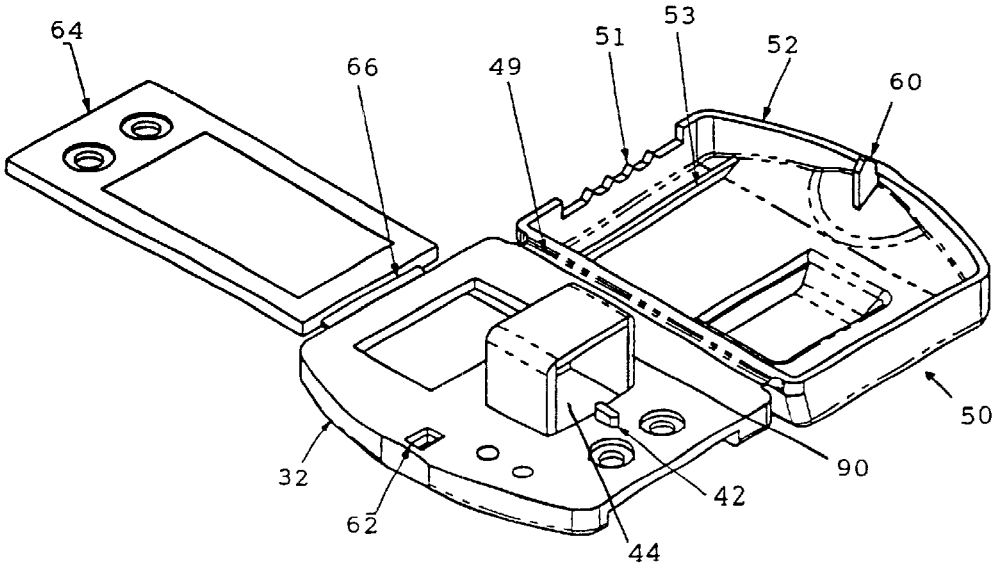
FIG. 4 is a top perspective view of the female/cover portion of the buckle of FIG. 1.
Figure 5:
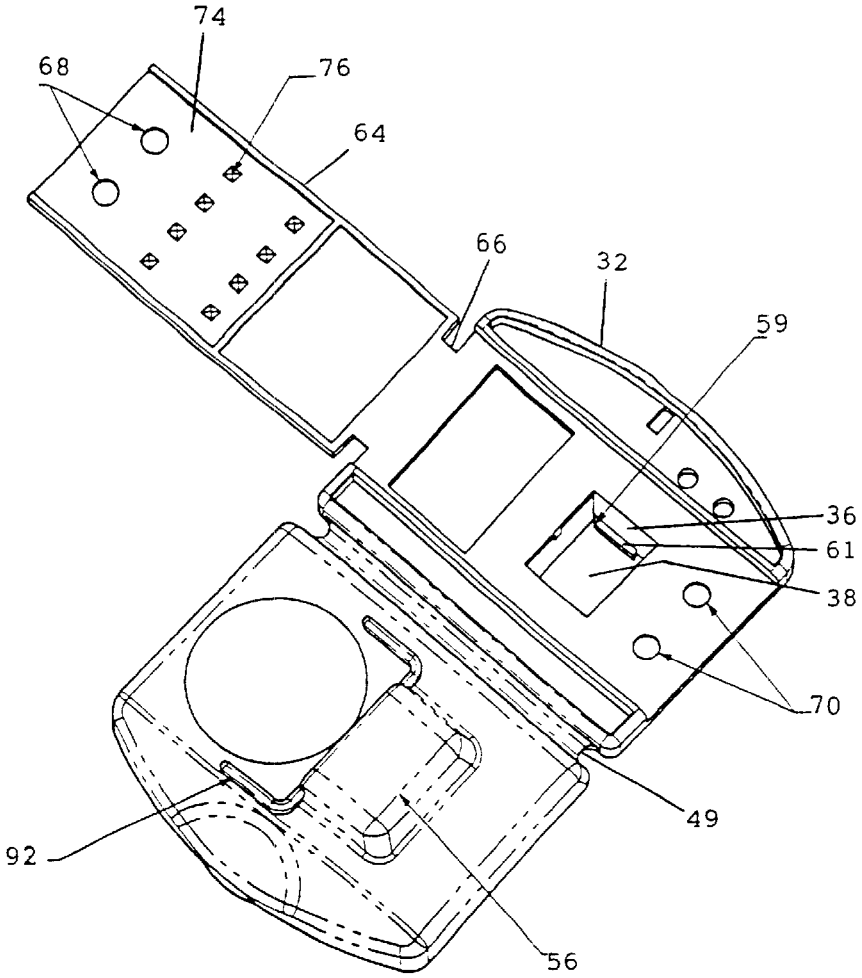
FIG. 5 is a bottom perspective view of the female/cover portion of FIG. 4.
Figure 6:
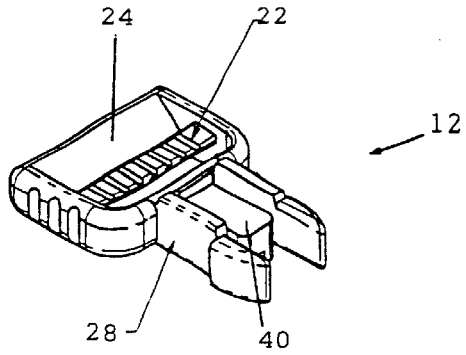
FIG. 6 is a top perspective view of the male portion of the FIG. 1 buckle.
Figure 7:
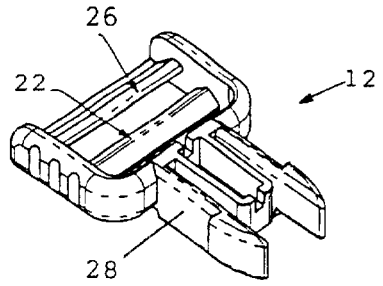
FIG. 7 is a bottom perspective view of the male portion of FIG. 6.

As an alternative construction the ribs 59 may be omitted and the passageway 30 sized so the arms 84 extend through the passageway and the barbs 86 engage the end wall 90 (see FIG. 4).

Figure 3:
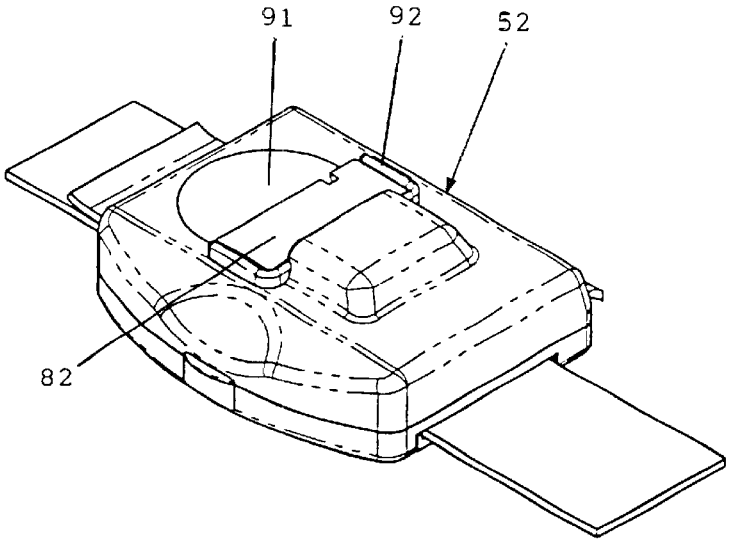
FIG. 3 is a perspective view of the buckle of FIG. 1 in a fully assembled state.

The seal 80 is constructed of a relatively weak material, such as a plastics material and may be destroyed by pivoting the cross bar 82 upwards to detach the cross bar 82 from the legs 84. Once destroyed the cover may then be raised to allow removal of the male clip 12 from the female channel 30. With particular reference to FIG. 3, to aid in the breaking of the seal 80 a recess 91 is provided on the top of the cover 52 to allow one to place a fingernail or the like under the cross bar 82 to raise it upwards. Since the seal 80 is relatively weak, the top of the cover 52 is provided with an upstanding rim 92 which surrounds the seal cross bar 82 and so aids in preventing the seal 80 being accidentally broken.

Figure 8:
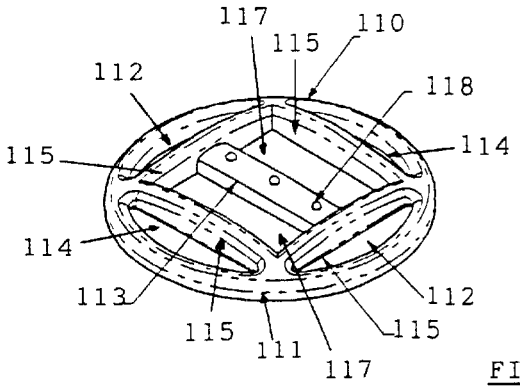
FIG. 8 is a top perspective view of a cross-over strap holder.
Figure 9:
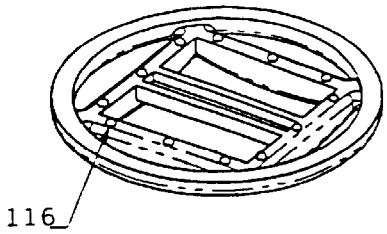
FIG. 9 is a bottom perspective view of a cross-over strap holder.

In FIGS. 8 and 9 there is shown a cross-over strap holder 110 in the form of a convex wheel having an external rim 111 and a plurality of bars extending across the rim 111. The holder 110 allows two tamper evident buckles 10 to be used substantially at right angles to one another. A first strap (not shown) is threaded from the top through one of a first pair of slots 112 on one side under a mid-wall 113 and out through the corresponding slot on the opening side. A second strap (not shown) is threaded in the same manner through a second pair of slots 114 oriented normal to the first pair of slots 112. In each case the strap travels in a tortuous path over the rim 111 under one of the bars 115 to effectively lock the straps in place. The holder 110 has raised underside bosses 116 on the upper side of the holder 110 to create additional friction with the straps. The mid-wall 113 enables the holder 110 to be used with a single strap whereby to secure its free end by threading the straps from the bottom of the holder 110 through a pair of slots 117 located either side of the mid-wall 113, through the clip 12 and then back through the holder 110 following the same path. Raised upper bosses 118 create additional friction whereby to prevent the holder from sliding freely along the straps.

Figure 10:
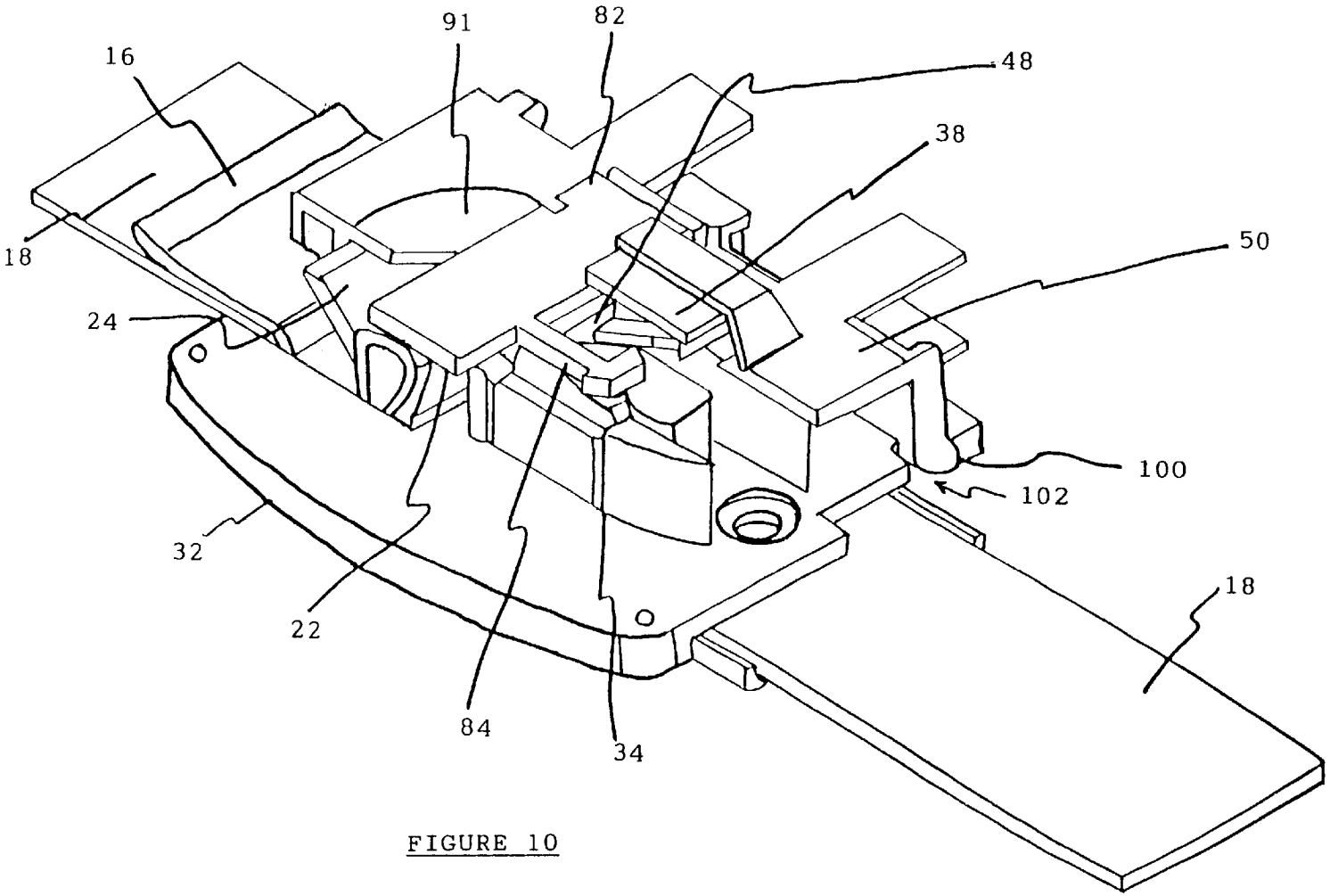
FIG. 10 is a cut away perspective view of a second embodiment of the invention.

Referring to FIG. 10, there is shown a second embodiment in which like parts are numbered as in the first embodiment. The cover 50 is separate from the base 32 and is provided with two or more pivot arms 100 which engage in slots 102 in the base 32 and enable the cover 50 to pivot about the base 32.

It will be apparent to those skilled in the art that many modifications and variations may be made to the embodiment described herein without departing from the scope of the invention.

The term "comprise" and its derivatives as used throughout the specification and claims is intended to have an inclusive meaning unless the context requires otherwise.

What is claimed is:

1. A tamper evident buckle including:

a first part adapted to be attached to one end of an elongate strap;

a second part adapted to be attached to the other end of the strap;

said first part including first part engagement means and second part including second part engagement means including a pair of spaced apart arms for releasably engaging the first and second parts together;

an enclosure movable between a first position wherein the first and second parts are freely engageable and disengageable by moving the arms relative to each other and a second position wherein the enclosure substantially encloses the engaged together first and second parts; and a seal including a main body, comprised of at least one component, and at least one deflectable member, wherein the seal is adapted to engage the enclosure in the second operative position and to prevent movement from the second operative position to the first operative position unless said seal is broken.

2. A tamper evident buckle according to claim 1, wherein the enclosure includes a base and a cover.

3. A tamper evident buckle according to claim 2, wherein the first part and the base are an integral component.

4. A tamper evident buckle according to claim 1, wherein the first part includes a female member for receiving the second part.

5. A tamper evident buckle according to claim 4, wherein the female member includes a passageway and the second part engagement means is adapted to releasably engage the passageway.

6. A tamper evident buckle according to claim 5, wherein the arms must be pressed toward each other to enable the release of the second part engagement means from the passageway.

7. A tamper evident buckle according to claim 6, wherein the second part includes a transverse body from which the pair of arms extend, said transverse body having an upper surface which is lower than the upper surface of the pair of arms so that when engaged by the passageway an opening is defined above the transverse body and between the pair of arms, and wherein the cover has a slot in registry with the opening, whereby the deflectable member is adapted to be received through the slot and into the opening.

8. A tamper evident buckle according to claim 5, wherein one or both of the arms include a re-entrant barb adapted to engage the passageway.

9. A tamper evident buckle according to claim 1, wherein the deflectable member extends outside a plane of the main body.

10. A tamper evident buckle according to claim 1, wherein the main body is comprised of at least two distinct components which are joined by a frangible connection and wherein the seal is adapted to prevent the movement from the second operative position to the first operative position unless the frangible connection is broken.

* * * * *